United States Patent [19]

Dennison et al.

[11] Patent Number: 4,939,512

[45] Date of Patent: Jul. 3, 1990

[54] MODULAR, NON-METALLIC, HARD SHELL, PREDIMENSIONED, PREFORMED AND SEALED INDUCTION LOOP VEHICLE DETECTION SYSTEM AND METHOD OF INSTALLATION

[76] Inventors: James L. Dennison, 213 Tait Ave.; Douglas B. MacDonald, 204 Tait Ave., both of Los Gatos, Calif. 95030

[21] Appl. No.: 72,098

[22] Filed: Jul. 13, 1987

Related U.S. Application Data

[63] Continuation-in-part of Ser. No. 930,726, Nov. 13, 1986.

[51] Int. Cl.[5] ..... G08G 1/01

[52] U.S. Cl. ..... 340/933; 174/71 R; 174/92; 285/302; 340/941

[58] Field of Search ..... 340/933, 935, 939, 941; 285/92, 224, 302; 403/220, 291, 300; 404/11, 71, 72, 75; 180/167; 138/155; 174/71 R, 92

[56] References Cited

U.S. PATENT DOCUMENTS

| | | | |
|---|---|---|---|
| 2,095,061 | 10/1937 | Geyer | 94/18 |
| 2,409,283 | 10/1946 | Hudson | 285/115 |
| 2,441,554 | 5/1948 | Barker | 340/941 |
| 3,034,808 | 5/1962 | Poundstone | 285/235 |
| 3,087,747 | 4/1963 | Novotny | 285/398 |
| 3,151,211 | 9/1964 | Reid et al. | 174/92 |
| 3,173,989 | 3/1965 | Neaderland | 174/93 |
| 3,350,500 | 10/1967 | Ziegler | 174/89 |
| 3,711,633 | 1/1973 | Ghirardi et al. | 174/71 R |
| 3,714,626 | 1/1973 | Koerner | 340/38 |
| 3,794,054 | 2/1974 | Watts | 135/2 |
| 3,836,702 | 9/1974 | Plummer | 174/92 |
| 4,204,085 | 5/1980 | Chapman et al. | 174/21 CA |
| 4,294,475 | 10/1981 | Kanai et al. | 285/302 |
| 4,358,634 | 11/1982 | Dienes | 174/92 |
| 4,374,596 | 2/1983 | Schlemmer et al. | 138/155 |
| 4,396,656 | 8/1983 | Still et al. | 174/92 |
| 4,449,844 | 5/1984 | Larsen | 404/60 |
| 4,514,241 | 4/1985 | Maukola | 156/79 |

FOREIGN PATENT DOCUMENTS

| | | | |
|---|---|---|---|
| 2129230A | 5/1984 | United Kingdom | 174/92 |

OTHER PUBLICATIONS

"Inductive Loops", Equipment Development & Test Report No. 7700-9, Aug. 1977, Loren F. DeLand, U.S. Dept. of Agriculture.

*Primary Examiner*—Joseph A. Orsino
*Assistant Examiner*—Brent A. Swarthout
*Attorney, Agent, or Firm*—Flehr, Hohbach, Test, Albritton & Herbert

[57] ABSTRACT

An induction loop vehicle detection system and method of making and installing such a system are disclosed wherein the conduit sections containing the induction loop are preformed and prewired integrally with all interconnects by using removable expansion joints to assemble sections of prewired and sealed conduit in any desired configuration. The expansion joints can be removed after assembly to enable the induction loop to be folded down for shipment. The expansion joints also enable longitudinal displacement of the induction loop conduit due to thermal differential expansion during installation and during extreme changes in temperature over the lifetime of the system, thereby preserving the integrity of the roadway and fault free operation of the induction loop. The wires forming the induction loop are completely sealed within the conduit with an asphalt rubber material thereby precluding any moisture penetration. The induction loop vehicle detector is installed by a method of dry routing of pavement which eliminates labor intensive slurry clean-up. The conduit is sealed in the routed slot in a roadway with a pressure withstanding asphalt rubber material which tenaciously adheres to the side surfaces of the routed slot.

14 Claims, 11 Drawing Sheets

Fig. 1
(PRIOR ART)
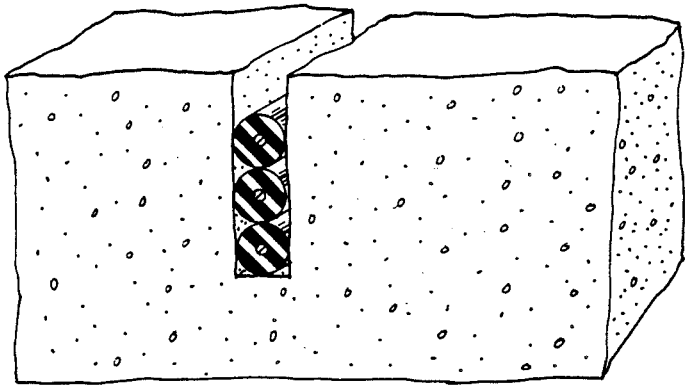
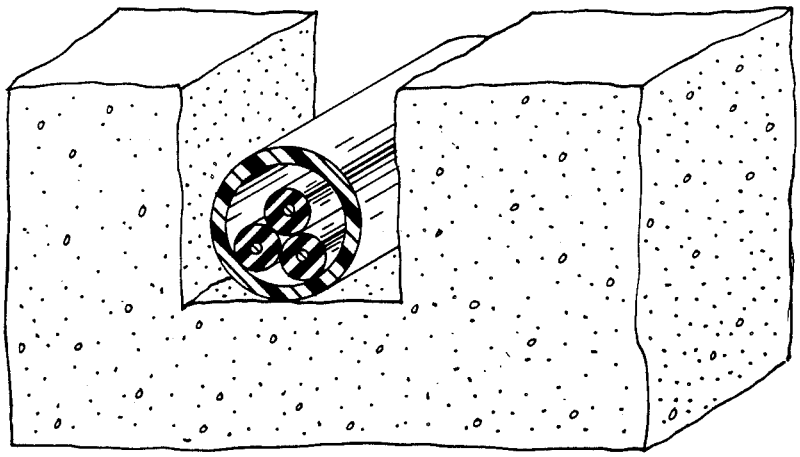
Fig. 2 (PRIOR ART)
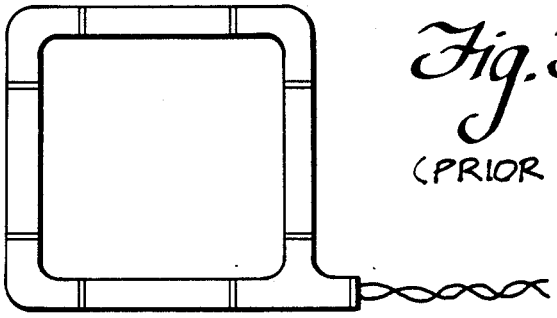
Fig. 3
(PRIOR ART)

MODULAR, NON-METALLIC, HARD SHELL, PREDIMENSIONED, PREFORMED AND SEALED INDUCTION LOOP VEHICLE DETECTION SYSTEM AND METHOD OF INSTALLATION

BACKGROUND OF THE INVENTION

This invention is a continuation-in-part of U.S. patent application Ser. No. 06/930,726, filed Nov. 13, 1986, entitled, CONDUIT-ENCLOSED INDUCTION LOOP FOR A VEHICLE DETECTOR.

This invention relates to induction loop vehicle detectors. More particularly, this invention relates to a completely predimensioned, prewired, modular induction loop vehicle detector assembly and method of installing and manufacturing the same in which the induction loop wires are completely sealed within the preconfigured conduit sections forming the induction loop. The modular aspect of the invention includes an expansion/contraction joint which serves as a removable coupling between end sections of the conduit. The expansion/contraction joints enable a preformed and predimensioned induction loop to be built in any desired configuration and then to be folded down for ease of carrying and for ease of assembly in the field. The expansion/contraction joints further enable the induction loop to be pressed into the hot, melted asphalt of a new or preexisting roadway without deformation of either the loop conduit or the roadway due to differential thermal expansion. The expansion/contraction joints provide a passageway for longitudinal displacement of the conduit due to thermal expansion, thus sustaining the entire movement of the conduit.

As the population of urban areas continues to grow at an unabated pace, there is a steadily increasing demand for existing roadways to handle increased vehicle traffic smoothly and efficiently. This has resulted in the need to detect, count and to monitor vehicles moving on freeways, expressways, bridges and the like in order to coordinate traffic flows through cities, to synchronize traffic signals and generally to effect an efficient, integrated flow of traffic over a wide area.

Induction loop vehicle detectors are used, among other things, to count and monitor traffic demand in order to control cross traffic at intersections, turn lanes, and freeway on ramps. Induction loop detectors also monitor vehicle traffic on freeways in order to control traffic signals at major freeway off ramps under varying conditions of traffic demand. Induction loop vehicle detection systems thus enable integrated control of traffic over a wide network of roadways. The use of induction loop vehicle detectors for these purposes is well established and is essential in order to facilitate the flow of traffic through crowded urban areas during peak commuter hours. Due to ever increasing urban traffic congestion and lack of new freeways, there is a great need for efficient, quick installation and sustained fault free operation of induction loop vehicle detectors.

The conventional prior art induction loop detector is installed in an existing roadway by cutting slots in the roadway with a concrete saw. The use of a concrete saw has several disadvantages. The concrete saw needs an abundant amount of water to cool the cutting blades. The water flowing continually over the saw blades forms a slurry which drains over the entire roadway and into all the slots. Consequently, the roadway needs to be cleaned and the slots need to be cleaned out and totally dried before an induction loop system can be installed. This is a labor intensive process which necessitates closing traffic lanes for a significant period of time. Such closure of traffic lanes for the installation of induction loop conductors often results in severe traffic congestion. The foregoing delays and inconvenience also result when an existing induction loop is in need of repair. Typically, an entire new loop must be installed, rather than repairing the old one, at a cost which exceeds that of the original installation.

A further disadvantage of the use of a concrete saw to install an induction loop detector is that the concrete saw is incapable of cutting a circular pattern. Often it is advantageous to lay induction loops in a circular configuration when installed in adjacent traffic lanes in order to prevent or minimize interference from vehicles in adjacent lanes. When induction loops are laid in a square or rectangular configuration, the loops often count vehicles which are not in the center of an adjacent lane or which stray over a lane line. In order to cut a circular path for the induction loop detector system, a concrete saw must make several overlapping straight cuts. This severely degrades the integrity of the roadway and increases the number of potential failure points where water could enter the buried loop detector and cause the system to fail.

The installation of a prior art PVC protected induction loop detection system without expansion/contraction joints in sawed slots in existing pavement has several problems. Careful and exact layout to within a quarter of an inch is required because of the fixed dimensions of the preformed loop. Doubling cutting of the pavement is required at corners and joint fittings. Due to its one piece construction, parts of the induction loop are susceptible to cracking due to overflexing of the PVC conduit during handling of the loops prior to or during the installation.

Once placed in the roadway, the induction loops must be connected to a control box typically located at the curb or side of the roadway where it is accessible. The connecting line from the loop to the curb side junction box which interfaces with the traffic signal controller is known in the induction loop vehicle detection art as a "home run". Home runs are difficult to field assemble and to install. The home run typically consists of a pair of wires which are twisted together approximately 4 turns per foot along their entire length. The twisted pairs forming the home run are necessary in order to cancel the electro-magnetic field associated with each wire and thereby prevent the home run from becoming an active detector. Conventionally, the home run is extended from each inductor loop to the curb side junction box for splicing in the field. Conventionally, a separate home run is connected to each induction loop which adds considerable non-working inductance thereby desensitizing the system. A rigidly manufactured system would limit the configurability of the induction loops in the field and would make the loops bulky and almost impossible to transport. Because separate home runs are necessary to connect all inductor loops to their associated curb sided junction boxes, the installation of the multiple home runs necessitates additional saw cuts which severely deteriorates the integrity of the roadway. The disadvantages in terms of construction time, lane closure and traffic congestion caused by such installation are obvious.

A further disadvantage of prior art in using hard shell induction loop vehicle detection systems without expansion/contraction joints is that the conduit housing the conductor for the induction loop is typically PVC conduit. PVC conduit has a greatly different thermal expansion coefficient from the asphalt or concrete pavement in which it is buried. The conventional induction loop has no provision for displacement of the conduit due to thermal expansion. During installation in hot asphalt or later during extreme temperature changes, the conduit has no place to expand upon heating and can become severely deformed causing the sealant to buckle or crack. The induction loop itself can become severely damaged and/or glued conduit couplings can pull apart. Ground water can enter cracks in the conduit or pavement causing the entire induction loop system to malfunction. Problems due to differential thermal expansion are exacerbated by the rigid, inflexible nature of the conduit and by the propensity of the PVC material to break down in cold weather.

The conventional induction loop is rigid and fixed in dimension. Expansion and contraction due to even normal changes in temperatures can cause movement and breakup of the pavement in which the conduit is encased. This in turn creates physical stress and wear on the loop conductor wire which breaks down its protecting insulation. With the conventional method of installing an induction loop detector, the wire is wound very tightly in the slot in the pavement and has little ability to react to expansion and contraction. Mechanical failure can result when the conductor wire of the detector loop is severed. This can happen due to mechanical movement by heavy trucks displacing the wire or failure or cracking of the roadway due to continual expansion and contraction by temperature.

Another problem with the conventional induction loop concerns the material used to seal the saw cut in which the loop is placed. The conventional epoxy seal has a high rate of failure due to brittleness and lack of adhesion to the sides of the saw cut.

Epoxy sealants are susceptible to being mixed improperly and can often exceed their shelf life before use without detection. Epoxy has a very limited expansion/contraction capability when exposed to extreme temperatures. As noted above, the propensity of epoxy to cracking and failure is exacerbated by the differential thermal expansion of the PVC conduit. Thus, the seal is typically prone to failure. Once the seal's integrity is penetrated, potential degradation of the induction loop arises from freeze/thaw temperature cycles and electrical current leakage to ground caused by moisture penetration. Seal breakdown is also a primary cause in the development of potholes in roadways which expose the induction loop to mechanical failure. This typically occurs when the sealant or roadway fails and the wire is exposed to direct vehicle abuse or to sharp rocks or other objects which are forced into induction loop slots.

Other sealants in use have similar disadvantages. If too soft they allow penetration of the loop by foreign objects. If too hard or brittle (inelastic), continuing thermal cycling breaks the weak adhesive bond between the sealant and the edge of the slot. Thus exposing the wires to moisture penetration.

A further disadvantage or the typical induction loop detector is a propensity to electrical failure in splices and connections due to poorly applied insulation which allows the wires to be exposed and subjected to corrosion. This damages the electrical properties of the splice. Wire corrosion and oxidation increase the wire resistance by reducing the effective cross sectional area. Thus, it is essential to keep moisture from penetrating through the insulation to the wire surface. Thus, it can be seen that any interconnection or splicing of induction loops and leads to control boxes must be insulated in a manner that will absolutely lock out all moisture.

Induction loop degradation is dependent upon the ability to insulate the loop from the surrounding elements, particularly moisture and oxidizing ambients. These contribute to corrosion which increases the resistance of the loop, and to leakage paths to ground which lower the effective inductance of the loop.

The quality of a typical induction loop is defined at a particular frequency as the ratio of the reactance or energy storing capacity of the loop to the resistance:

$$Q = \frac{\omega L}{R}$$

where $\omega$ the frequency in radians/sec.

L=loop inductance in Henries

R=loop resistance in Ohms

A loop's inductance is thus determined by the geometry chosen and is accordingly fixed. The resistance of the induction loop however is determined by several factors, any one of which can vary over the lifetime of the system. In dry pavement, an induction loop detector can have a leakage resistance to ground exceeding several billion Ohms. However, on a wet day a single crack or defect in the wire insulation can decrease this resistance to only several Ohms. On damp or humid mornings, this drop in insulating ability typically leads to impairment or failure of the detection system. Wire resistance is a function of diameter and to a lesser extent the frequency of operation. It has been found that smaller stranded wire can minimize the loss of resistance by increasing the surface area to volume ratio of the conductor according to the following formula:

$$\frac{\text{Surface Area}}{\text{Volume}} = \frac{2\pi r_{21}}{\pi r^{21}}$$

where:

r=radius of the wire strand; and l=length of the section

Accordingly, it has been found that better performance of an induction loop detector is obtained by using many strands of smaller diameter wire which yield the same cross sectional area as a single strand of larger wire.

A further disadvantage of the typical hard shell induction loop detector is that the conduit is hollow except for the conductor wire. When installed in the saw cut, the hollow conduit tends to float in the liquid sealant before the sealant congeals. The floating of the conduit deforms the dimensions of the loop and also allows mechanical damage from vehicle traffic. The unsealed wire conductor will also move about within the conduit. This has the effect of detuning the induction detector by changing the inductance of the loop away from the calibrated inductance. Also, the lack of a sealant around the wires within the conduit allows the wires to change position by reason of the pressure exerted on the roadway by traffic and by differential thermal expansion. This further detunes and changes the inductance of the inductor loop.

Therefore, it is apparent that what is needed is an induction loop detector having a conduit filled with a resiliant, flexible sealant to completely protect the induction wires from moisture and corrosion. It is also desirable to have a flexible induction loop conduit which can expand and contract without damaging the roadway, the loop conduit or the enclosed induction wires when subjected to extreme temperature changes during installation and during the lifetime of the system.

The induction loop detection system preferably should be completely preconfigured and modular to provide for quick assembly and installation in the roadway to minimize traffic congestion and closure of traffic lanes. Also needed is a new method of installing and sealing an induction loop detection system in a roadway so that the sealant does not crack or otherwise deteriorate and expose the induction loop conduit to damage. Such a non-cracking, resilient sealant would greatly enhance the lifetime of an induction loop system and prevent costly repairs and traffic congestion incident to repairing an induction loop installed in a roadway.

SUMMARY OF THE INVENTION

In order to overcome the above discussed disadvantages of known induction loop vehicle detection systems, the present invention provides a preformed, nonmetallic, hard shelled, completely predimensioned and sealed modular induction loop vehicle detector having removable expansion joints. The expansion/contraction joints provide for thermal differential expansion of the loop conduit during installation and when the loop is in place in the roadway. The expansion/contraction joints also enable the conduit sections from the induction loop to be broken down for ease of carrying and reassembly in the field.

The present invention also includes a method of installation of the foregoing induction loop assembly by dry routing rather than by using a water cooled concrete cutter. As noted above, this completely eliminates the time consuming cleaning up of slurry and the drying out of saw cuts. Routing permits a simple clean up of vacuuming or sweep up of debris. Installation by routing also allows the pavement to be cut in a circle. This enables the loops to be preformed in a circular configuration to minimize adjacent lane interference. Routing eliminates the need for numerous straight line cuts in the pavement to approximate a circle and enables the conduit to be installed quickly while maintaining the integrity of the roadway. The method of installation of the induction loop detector in accordance with the present invention also provides an asphalt rubber sealant used to fill the routed slot in the pavement. The asphalt rubber sealant contains a high polymer content which provides a firm but flexible surface and is resistant to cracking. The routing of the slots for the conduit as opposed to saw cutting, creates jagged edges in the walls of the cut. This further provides for improved bonding of the sealant to the walls of the slot. This results in a bond that is impervious to moisture, thus prolonging the lifetime of the induction loop system.

The induction loop detector according to the present invention includes a flexible polypropylene, PVC, or CPVC conduit having "goose neck" shaped corner sections. It has been found that the goose neck configuration enables a conduit corner section to fit easily into a square cut or routed ninety degree corner without deforming or stressing the conduit and without consequent loss of structural integrity.

A further aspect of the invention includes a snap over expansion sleeve which can be configured as a T joint joining at least three sections of conduit or a sleeve joining two conduit ends. The snapover expansion sleeve is designed for field assembly to fit permanently over both a joint body and a conduit, respectively. The area beneath sleeve forms a chamber which provides for longitudinal displacement of the conduit and the enclosed sealed conductor caused by differential thermal expansion.

It can be appreciated that the expansion joints of the present invention have a significant advantage over the prior art in enabling an induction loop detector to be fully predimensioned, preformed and prewired at the factory in accordance with any configuration desired by a customer. The expansion joints and expansion T fittings further enable the "home run" and/or interconnects between the induction loop and the curb side junction box to be prewound and fully sealed and spliced to the induction loop at the factory in any desired length. This obviates the aforementioned disadvantages inherent in the intricate process of winding the electro-magnetic field cancelling loops into the home run wires while in the field.

With the present invention, a highway department or other public agency can order a completely predimensioned, preformed, prewired and sealed induction loop vehicle detection system including the home run or interconnects to the curb side junction box. The expansion joints enable the entire system to be folded down for modular assembly in the field one lane at a time. Thus, other traffic lanes can remain open while an entire predimensioned induction loop detection system is being installed.

The present invention results in a further advantage over prior art induction loop assemblies in that the induction loop conduits can be placed in routed cuts in the roadway in as little time as five minutes. Installation of an induction loop assembly in accordance with the present invention eliminates the costly and time consuming slurry clean-up and drying out process inherent in the prior art methods of installation using concrete saws. Thus, the total elapsed time between the start of a lane closure to install an induction loop system of the present invention and the reopening to traffic can be as little as two hours.

BRIEF DESCRIPTION OF THE DRAWINGS

These and other advantages of the present invention may be appreciated from studying the following detailed description of the presently preferred exemplary embodiment together with the drawings in which:

FIG. 1 shows a cross-section of a prior art inductive loop installation;

FIG. 2 shows a cross-section of a prior art hard shell inductive loop installation;

FIG. 3 shows a prior art rigid dimensioned inductive loop;

DETAILED DESCRIPTION OF THE PREFERRED EMBODIMENT

FIG. 1 shows a prior art 3 turn induction loop installation in a saw cut. FIG. 2 shows a typical prior art PVC installation of an induction loop in a roadway. Note that the PVC conduit is not filled with sealant thus allowing the wires to move within the conduit. FIG. 3 shows a schematic view of a predimensioned PVC induction loop detector. Note the absence of expansion/-contraction joints severely limits its usefulness.

Figure 4:
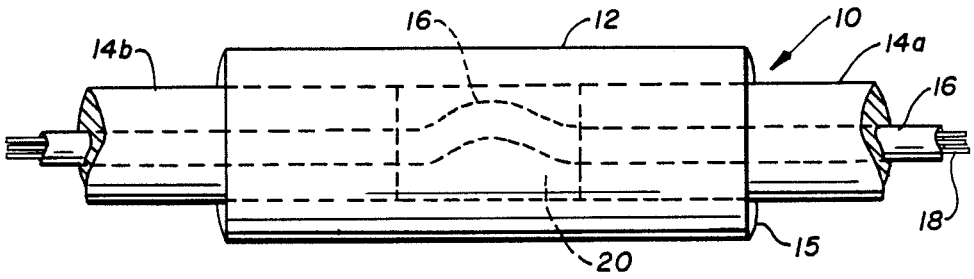
FIG. 4 is a side view of an expansion joint showing two sealed and prewired conduit ends and their associated expansion/contraction cavity according to the present invention.

Referring to FIG. 4, an expansion joint 10 according to the present invention comprises a body 12 having a central bore 15 along a longitudinal axis for receiving conduit ends 14*a* and 14*b*, respectively. The body 12 of the expansion joint 10 is composed of schedule 80 ¾ inch polypropylene or polyvinylchloride (PVC) pipe. The conduit ends 14*a* and 14*b* house the conductor wires 18 used for the inductive loop. The conduit is typically composed of schedule 80 ¾ inch PVC or polypropylene pipe. PVC typically has a working temperature of 300–400 degrees F at which point it can be bent into desired corner configurations. Polypropylene has a working temperature of 392–425 degrees F. It has been found that the ¾ inch is an optimal size for the conduit. This size permits the use of a single cut groove in the pavement for installation and eliminates the need for double cutting. Wires 18 are thin strand wires such as 14 THHN - THWN or 16 TFFN - MTWW gauge. It has been found that multiple turns of wire optimize the quality of the induction loop. Six turns of 16 gauge TFFN wire can be used in a ¾ inch conduit. Three turns of wire are shown in FIG. 4 for purposes of illustration. A flexible asphalt rubber sealant 16 sealably surrounds the conductor wires 18 and entirely fills the interior of the conduit sections 14*a* and 14*b*. A typical asphalt rubber sealant is manufactured by Crafco Inc., 6975 West Crafco Way, Chandler, Ariz. 85226. The Crafco sealant type is denoted "loop detector sealant". This is a hot pour polymer modified bituminous compound. It is supplied in solid form and is melted at a temperature of 400 degrees F. and applied to the conductor wires in conduit through a hot melt injector such as that manufactured by Slatterbach Corp. of Seaside, Calif. The Crafco sealant is found to be particularly advantageous because it specifically adheres to the conductor and conduit walls forming a perfect seal from one end of the conduit to another, thereby assuring that the conductor stays moisture-free, even if the the conduit should crack.

The longitudinal bore 15 provides a cavity 20 for expansion and contraction of conduit ends 14*a* and 14*b*. Conduit ends 14*a* and 14*b* are displaced longitudinally within cavity 20 as they expand or contract due to changes in temperature. This is particularly advantageous when installing an induction loop detection system with hot asphalt rubber sealants. Because the thermal expansion coefficient of PVC or polypropylene conduit is different from that of asphalt, the conduit can become severely deformed and push up through the loop sealant during installation. In addition, due to seasonal temperature changes, the typical prior art induction loop conduit seeks to expand and contract within the asphalt thus weakening the roadway or damaging the enclosed induction loop. This results in a reduced lifespan of the induction loop detector and failure of the system. These problems are overcome by the expansion joint according to the present invention which provides a means whereby the polypropylene or PVC conduit can be longitudinally displaced due to expansion and contraction within the cavity 20. Thus, the integrity of the induction loop system is preserved. The induction loop of the present invention also can be press installed in hot asphalt without danger of deforming the loop or the pavement due to the different thermal expansion coefficient between pavement and the induction loop conduit. All the longitudinal expansion of the conduit due to heating is taken up within the expansion joint.

Figure 5:
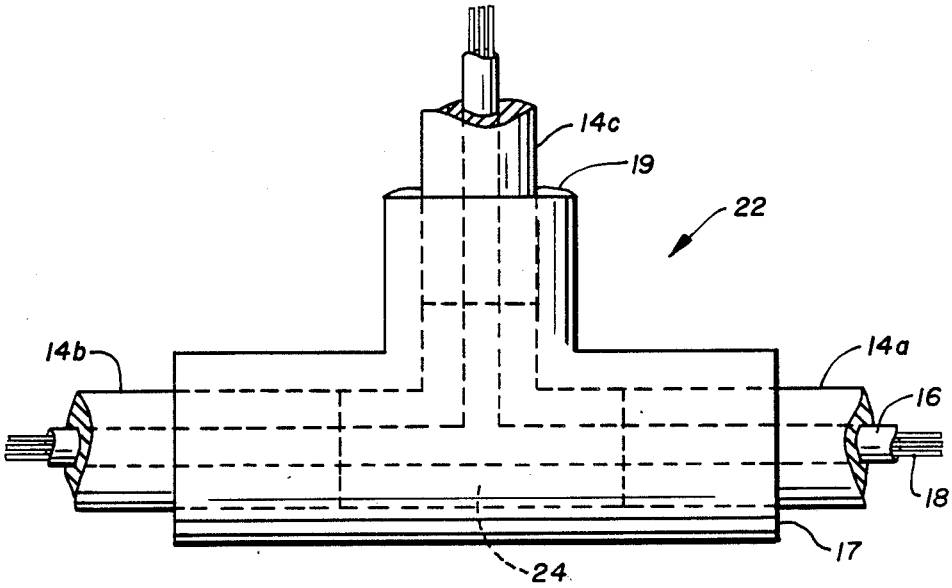
FIG. 5 is a perspective view of a T type expansion joint/showing three prewired and sealed conduit ends according to the present invention.

Referring to FIG. 5, a T type expansion joint according to the present invention provides a T shaped body 22 for joining together three conduit sections 14*a*, 14*b* and 14*c*, respectively, and for joining the sealed induction loop conductor 16 or 18 in each end section of conduit. Those having ordinary skill in this field will understand that an expansion joint may come in a variety of sizes and shapes. It is to be understood that this invention is directed toward an expansion joint which may be used for joining conduit sections of an inductive loop detector and enabling longitudinal displacement of those sections. Thus, the limitation of three end sections is illustrative only.

The conduit end sections 14*a*, 14*b* are slideably received in longitudinal bore 17. Conduit end 14*c* is slideably received in transverse bore 19. These end sections 14*a*, 14*b* and 14*c* can slide freely within the cavity 24 formed by the intersection of bores 17 and 19. Expansion or contraction of the conduit end sections 14*a*, 14*b* and 14*c* due to changes in temperature results in longitudinal displacement of the end sections within the cavity 24.

Figure 6:
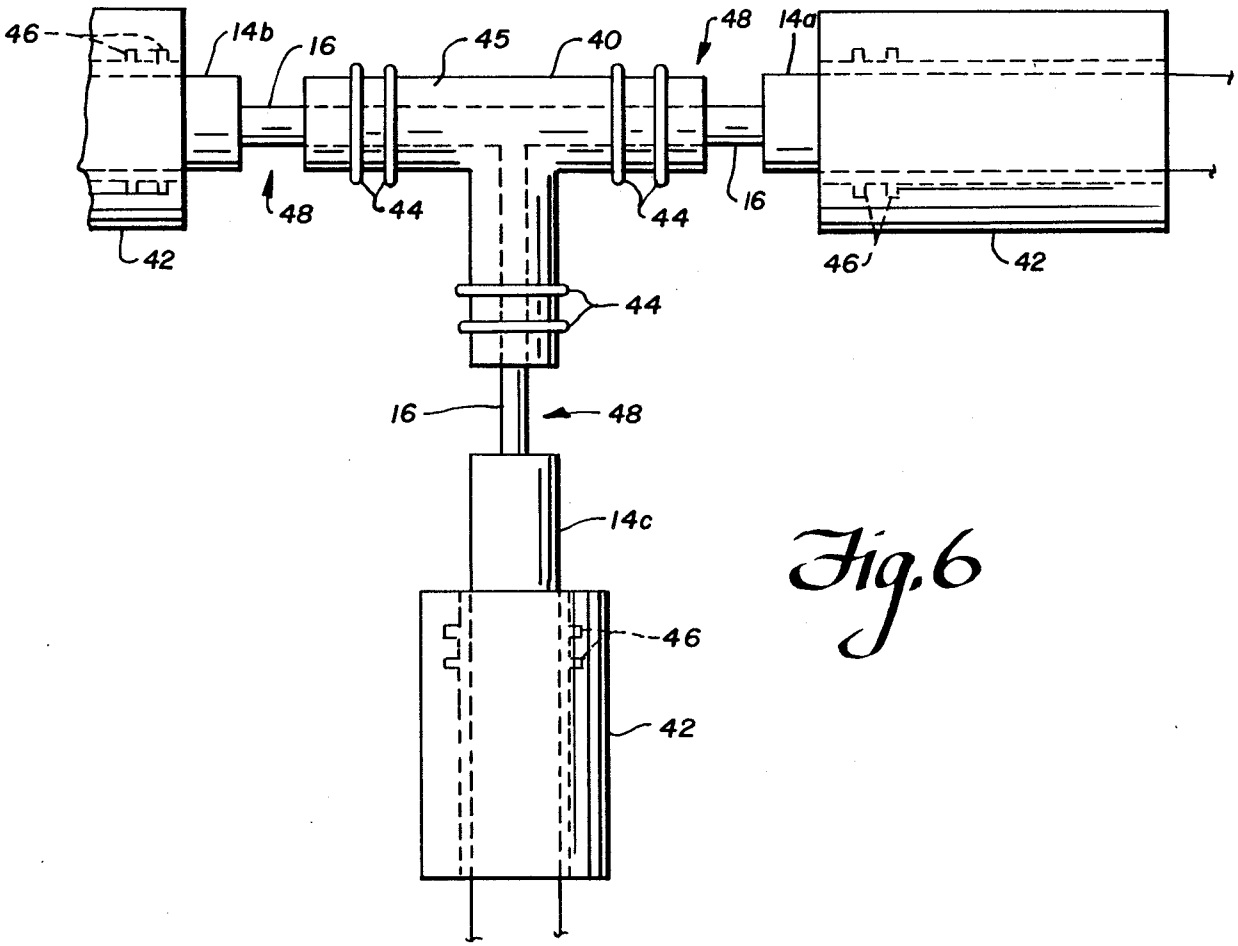
FIG. 6 is a top view of an alternate embodiment of the T type exansion joint according to the present invention.

FIG. 6 shows an alternate embodiment of an expansion/contraction joint for joining together three sections of a sealed conductor 16 which forms an induction loop and the PVC or polypropylene conduit end sections 14*a*, 14*b*, 14*c* which enclose the sealed induction loop conductor 16. The conductor 16 is continuous through the rigid T fitting 40. The T fitting 40 is permanently sealed with an asphalt rubber sealant 45 which entirely fills the interior of T fitting 40. The outer surface of the ends of T fitting 40 are provided with a series of projections or ridges 44. These projections or ridges 44 provide mechanical engagement with the interior of sleeves 42. Sleeve 42 has a series of indentations 46 on its interior surface which correspond to ridges 44 on the ends of joint 40. Thus, in operation, an expansion joint is formed in the field by sliding sleeve 42 over an end of T fitting 40 so that the indentations 46 come into permanent engagement with ridges 44. The conduits 14*a*, 14*b*, 14*c* are still able to slide freely within the interior of their sleeves 42. When sleeve 42 is permanently engaged with T fitting 40, a displacement region 48 is formed within the interior of the sleeve 42 between the end sections of T fitting 40 and conduits 14*a*, 14*b*, and 14*c*. The displacement region 48 provides a space for longitudinal displacement of conduit sections 14*a*, 14*b*, 14*c* upon expansion or contraction. Thus, the sleeve 42 acts as an expansion joint. It should be noted that this form of expansion joint provides a joint having greater structural integrity due to the fact that the T fitting 40 is completely filled with sealant and thus able to withstand greater compressive forces than an expansion joint wherein expansion and contraction take place within the T joint as shown in FIG. 5. In the embodiment of FIG. 6, all longitudinal displacement of conduits 14*a*, 14*b*, 14*c* take place outside the T fitting and within the sleeve 42. This allows each branch of conduit 40 to be displaced independently, thus reducing the stress upon a single T joint.

Figure 7:
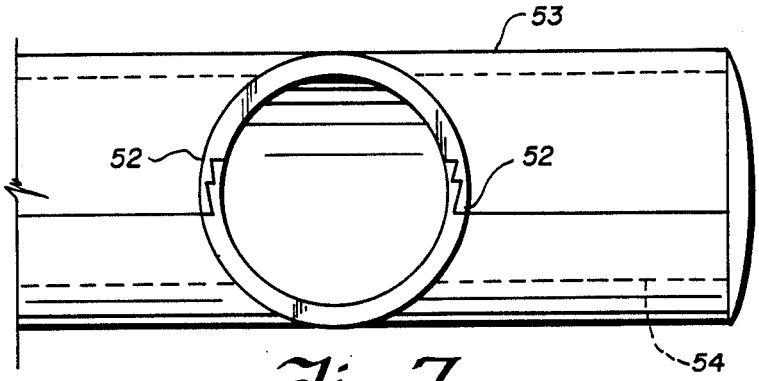
FIG. 7 is a front side view of a T type expansion joint formed by snapping together two complementary hinged halves.
Figure 8:
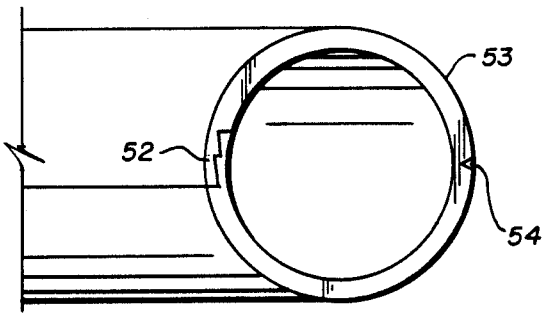
FIG. 8 is an end view of the T type expansion joint depicted in FIG. 6.

FIGS. 7 and 8 show the construction details of a T joint 53 which is assembled by folding together two symmetrical halves along fold joint 54. FIG. 7 is a front view of T joint 53 showing complementary toothed sections 52 which provide permanent mechanical engagement when snapped together. Note that this eliminates the need for using an adhesive during field assembly. FIG. 8 shows an end view of T joint 53 of FIG. 7. A flexible fold joint hinge 54 is integral with the body of the T joint and acts as a hinge for opening and closing the joint for final assembly.

Figure 9:
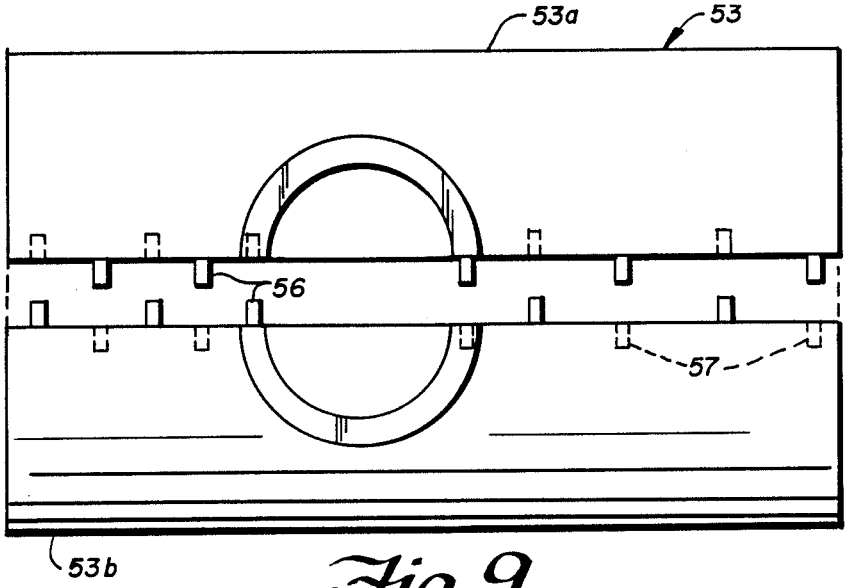
FIG. 9 is a front view of another embodiment of an T type expansion joint of FIGS. 6 and 7.

FIG. 9 shows an alternate embodiment of a T joint 53 composed of two complementary halves 53*a* and 53*b*. The T joint is assembled by pressing together the complementary toothed sections along its adjoining surfaces.

It can be appreciated that the expansion joints serve a dual purpose as fold down joints which allow the conduit ends to be slideably removed from the joints while the conductor forming the induction loop remains intact. This enables the induction loop to be folded down for ease of carrying and assembly in the field. The fold down aspect of the induction loop according to the present invention enables an entire induction loop detector system to be assembled in a modular fashion. This modularity enables the so called "home runs" or interconnects between the induction loop and the curb side junction box to be predimensioned and preassembled as an integral part of an induction loop detector system. The home runs are coupled to the main induction loop through an expansion joint. This provides a significant advantage over the prior art in which induction loop home runs had to be assembled in the field. The assembly of a home run in the field requires painstaking twisting of dual wires into loops in order to cancel the electric fields around each wire. In accordance with the present invention, a fully preassembled, predimensioned and sealed induction loop detection system is now integral with preassembled prewired and sealed home run connections which also can be folded down and easily reassembled in the field. This provides a significant savings in installation time because an entire induction loop detection system can be assembled in a modular fashion, requiring the closing of only one highway lane at a time.

A further aspect of the modularity of the induction loop according to the present invention is that a plurality of induction loops can be joined together in various configurations as shown in FIGS. 12–15. The loops can be arranged in any desired preplanned configuration by color coding or numbering the sections and then simply reassembling the loops in the field according to the predetermined code. It can also be appreciated that the expansion sleeve of FIG. 4 according to the present invention can be used as a protective expansion sleeve which can be slipped over a splice made anywhere in an induction loop or home run. Thus, the repair and splicing of a damaged induction loop in the roadway is greatly facilitated.

Figure 10:
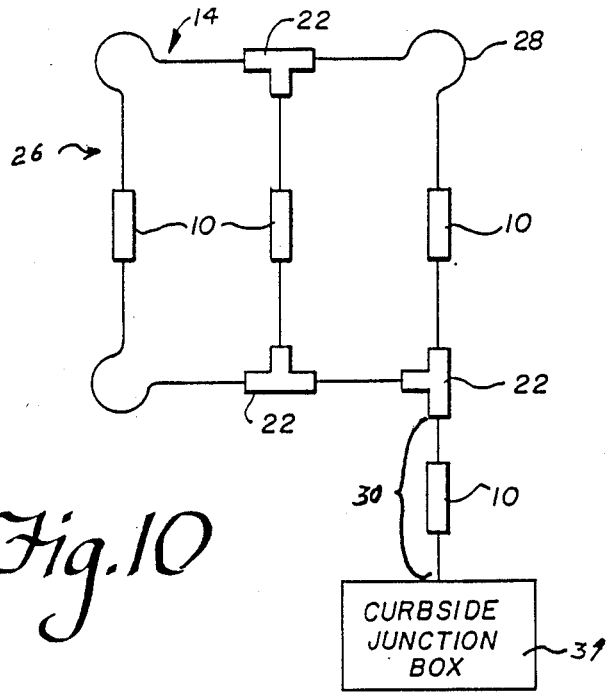
FIG. 10 is a schematic view of an induction loop vehicle detection assembly according to the present invention.

FIG. 10 shows the integration of T type expansion/-contraction joints, straight expansion joints and conduit sections to form a typical induction loop assembly 26. Expansion joints 10 are typically provided at 6 or 8 foot intervals. A T type expansion/contraction joint 22 joins the induction loop 26 with an interconnect or home run 30 to the curb side junction box 34 which is located near the curb or center divider section of a roadway.

Note that special "gooseneck" corners are used in order to enable the induction loop to be placed in a square cut without deformation or stress to the conduit. FIG. 11*a* shows a prior art conduit 27 which must be severely bent and deformed in order to fit into a square cut corner 25. Usually a third diagonal cut is required to remove sufficient material to allow the conduit to fit into the corner. This severely weakens the integrity of the roadway.

Figure 11:
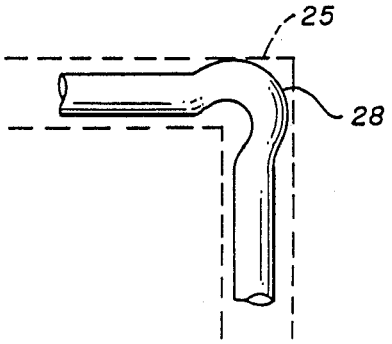
FIG. 11 is a top view of a corner section of an induction loop conduit according to the present invention.
Figure 11A:
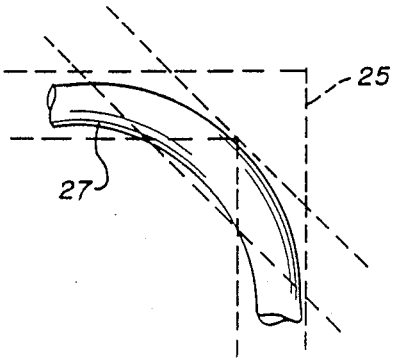
FIG. 11*a* is a top view showing difficulty of installing a prior art corner section of an induction loop conduit in a slotted ninety degree corner.

FIG. 11 shows a molded 90 degree corner section 28 of conduit made in accordance with the present induction loop assembly. The circular corner 28 according to the present invention enables the conduit to be placed easily within a square cut corner 25 without deformation or bending. This maintains the structural integrity of the conduit.

The foregoing expansion/contraction joints, T fittings and corner sections enable various layouts of an induction loop detector assembly as shown in FIGS. 12–15.

Figure 12:
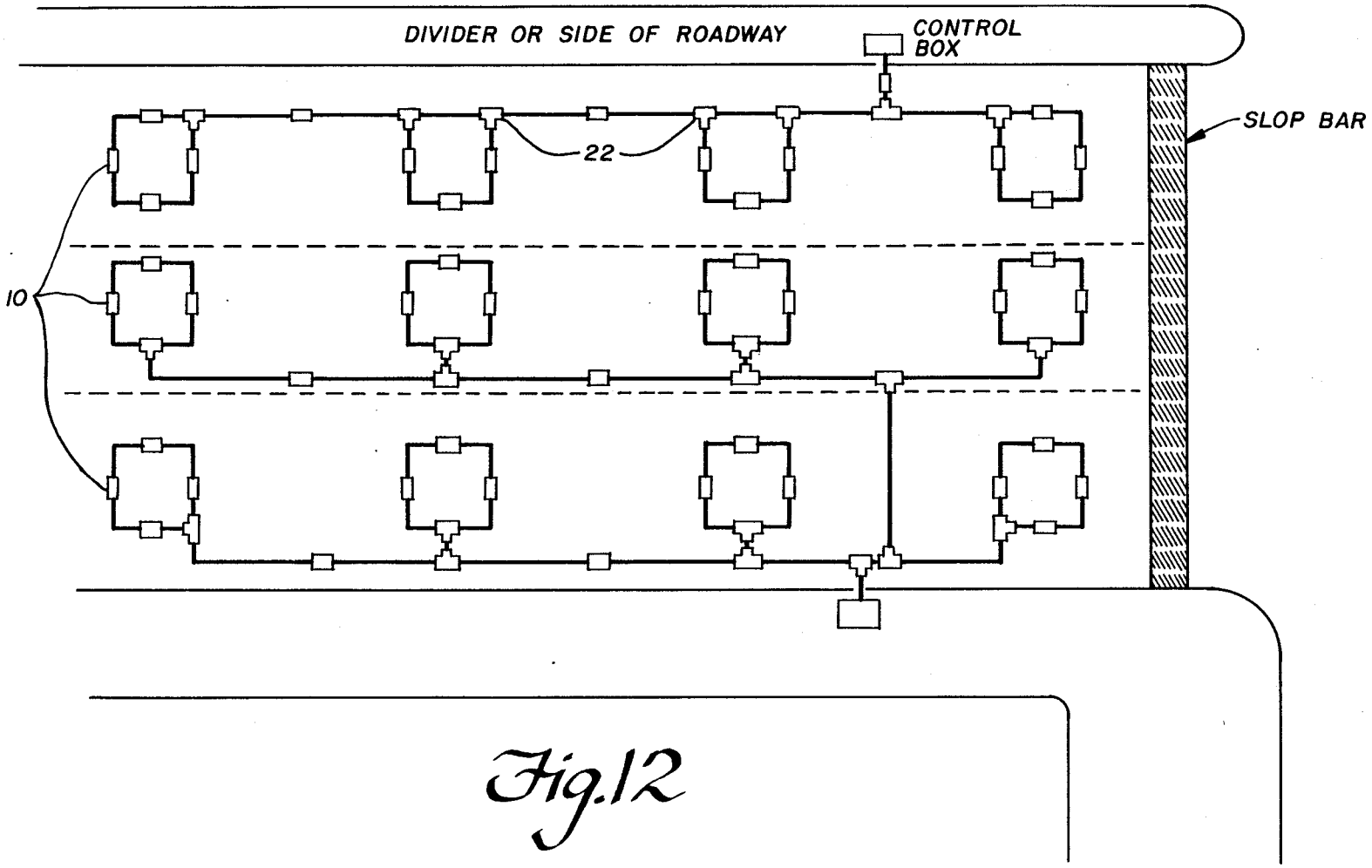
FIG. 12 is a schematic view of one embodiment of an induction loop vehicle detector assembly according to the present invention when installed in a roadway.

FIG. 12 shows a typical "in lane" layout of a series of induction loop detectors for detecting, counting or monitoring the vehicles in each lane of a roadway. Straight expansion/contraction joints 10 are placed customarily at 6 to 8 foot intervals. T type expansion/-contraction joints 22 are used to connect adjacent loops to one another and to the interconnect to the curb side junction box. T type expansion/contraction joints may be replaced by T fittings and expansion sleeves as shown in FIG. 6.

Figure 13:
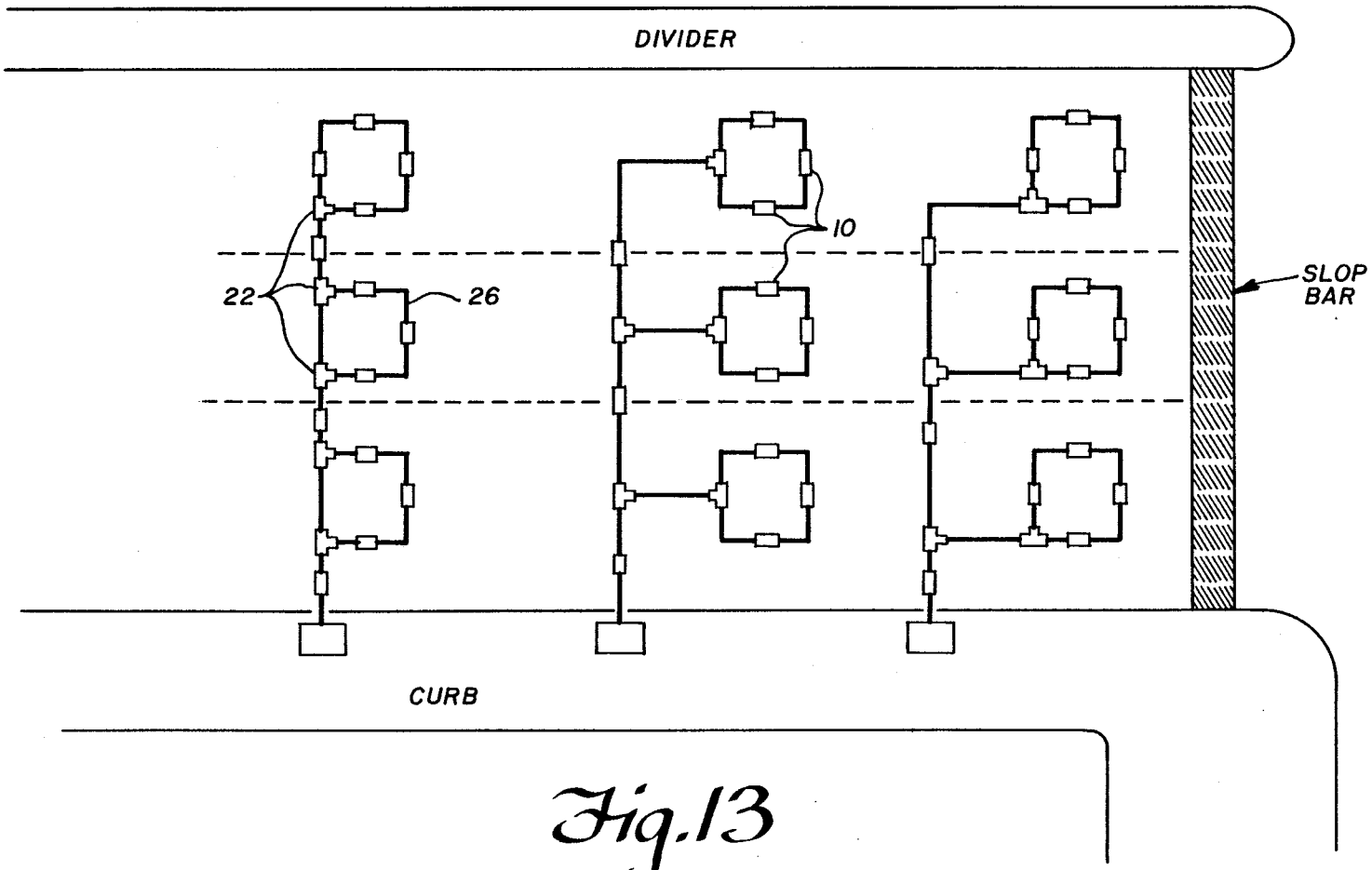
FIG. 13 is a schematic view of a second embodiment of an induction loop assembly according to the present invention when installed in a roadway.

FIG. 13 shows three typical layouts of the induction loop detector system across three lanes of a roadway.

Figure 14:
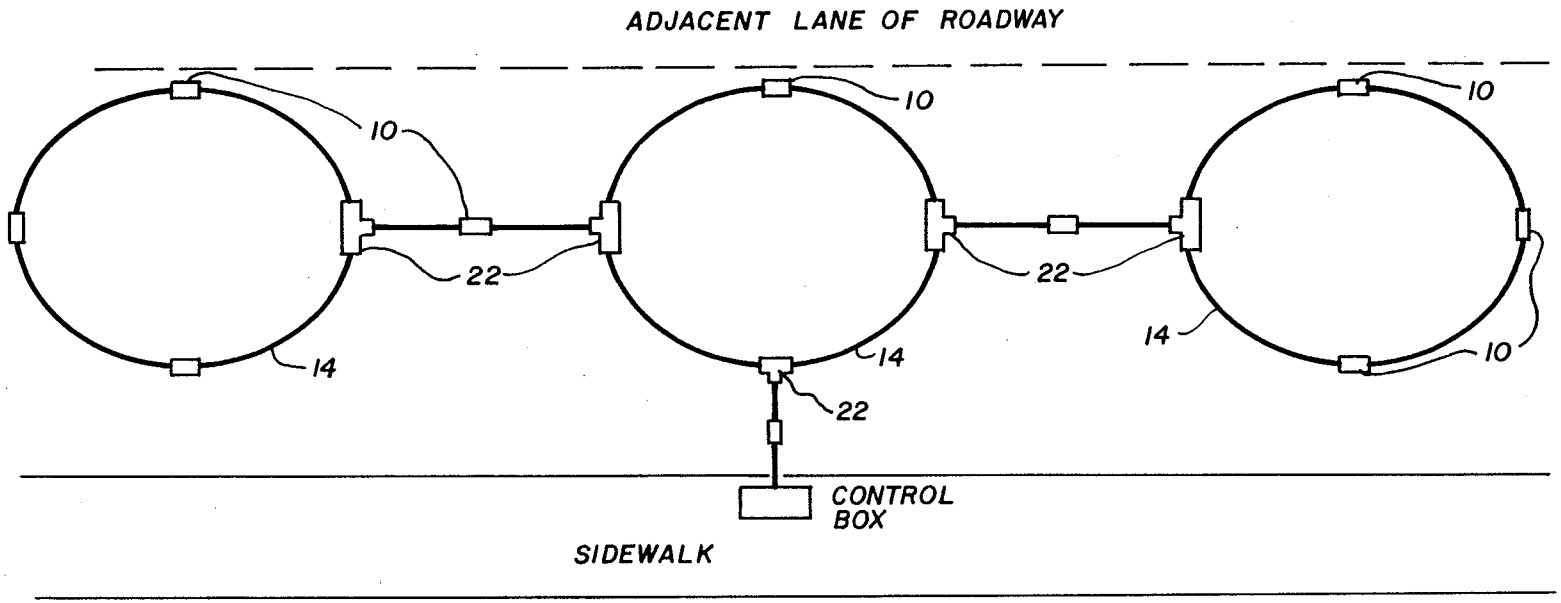
FIG. 14 is a schematic view of a third embodiment of an induction loop assembly according to the present invention when installed in a roadway.

FIG. 14 shows three circular induction loop detectors according to the present invention which have been placed in a lane of roadway. The circular loop configuration minimizes so called adjacent lane interference or the miscounting of vehicles from an adjacent lane which are not properly positioned in their lane. The circular configuration thus provides a higly accurate count of vehicles.

Figure 15:
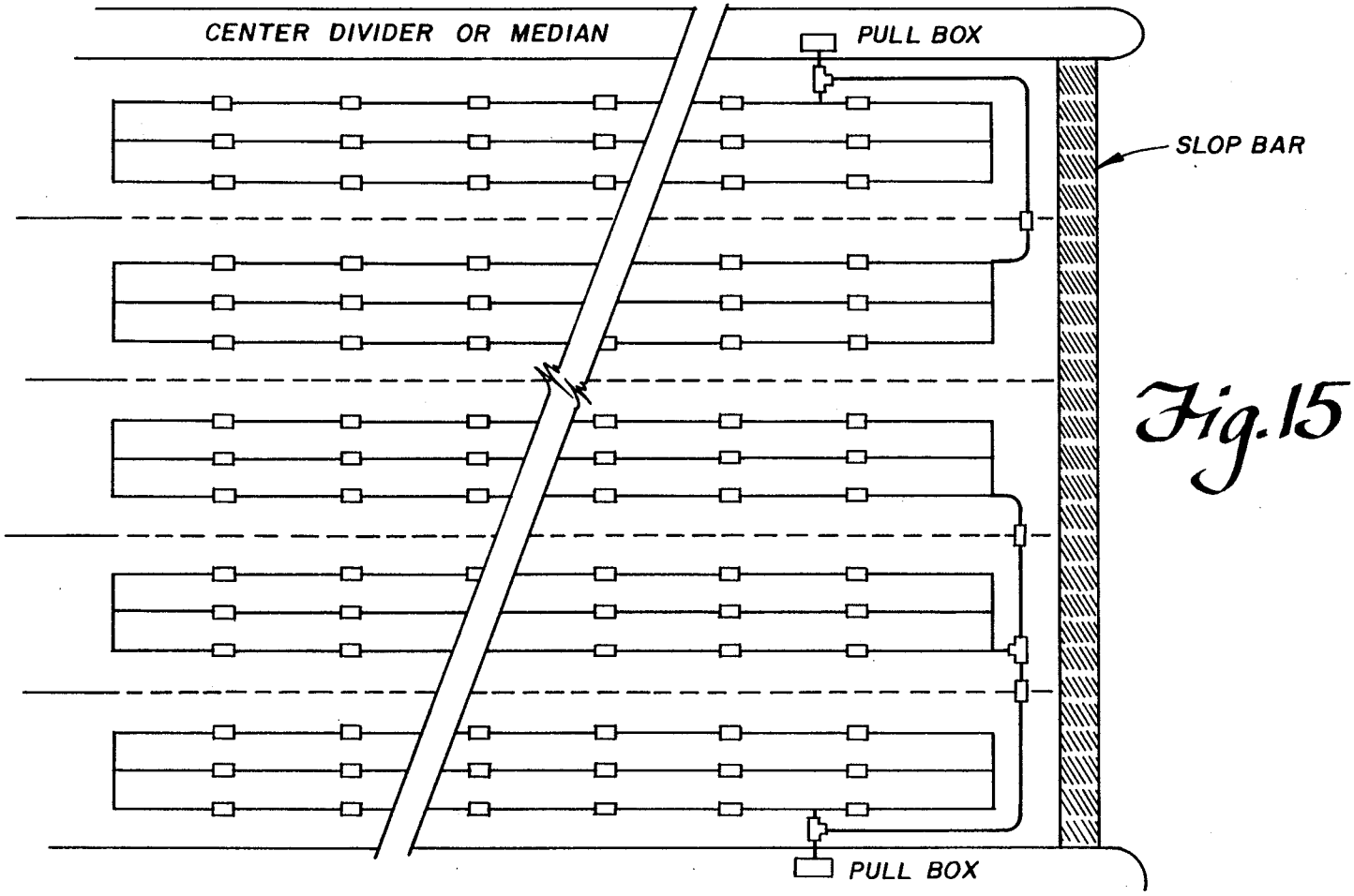
FIG. 15 is a schematic view of a modular induction loop assembly according to the present invention.

FIG. 15 shows the modular aspect of the present invention which allows extremely long interconnected loops which were previously unobtainable using the prior art.

The circular configuration of an induction loop detector is made possible by another aspect of the present invention, namely the installation of the present induction loop conduit in a road way through the use of routing rather than the typical prior art method which uses a concrete saw. A concrete saw is capable of cutting only in a straight line. Thus, the excessive number of cuts which would have to be made in pavement by a concrete saw in order to achieve a circular configuration would severely degrade the integrity of the roadway. In addition, only a small fraction of the space of all the cuts would be filled by the loop. The remaining over cuts would have to be filled with filler or sealant. Moreover, a concrete saw requires a tremendous amount of water to cool the saw blades. The water flowing continually over the saw blades creates a slurry material which washes into the saw cuts and over the entire roadway. The induction loop cannot be placed into the saw cuts until they have been laboriously cleaned out so as to remove all slurry material. The saw cuts also must be meticulously dried.

The installation of an induction loop detector according to the present invention requires the use of routing rather than a concrete saw. This eliminates the need for cooling water and therefore obviates the labor intensive slurry clean-up and drying out process of the prior art. A router can also make a single circular cut for the installation of an induction loop.

Figure 17:
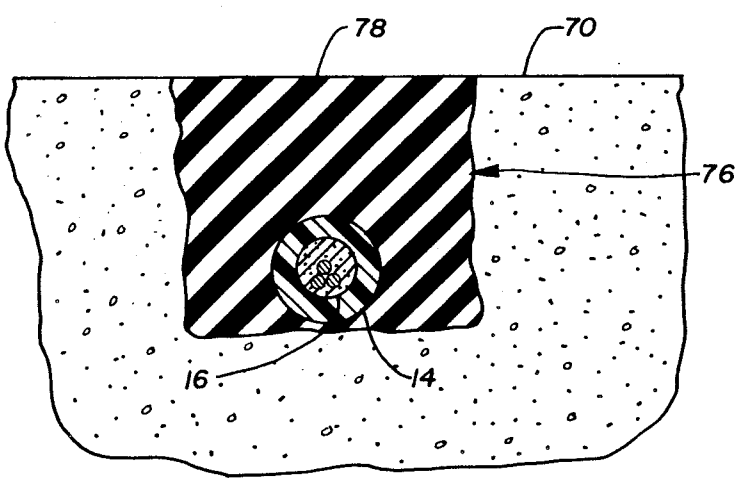
FIG. 17 is a side sectional view depicting the installation of induction loop conduit in a roadway according to the present invention.
Figure 16:
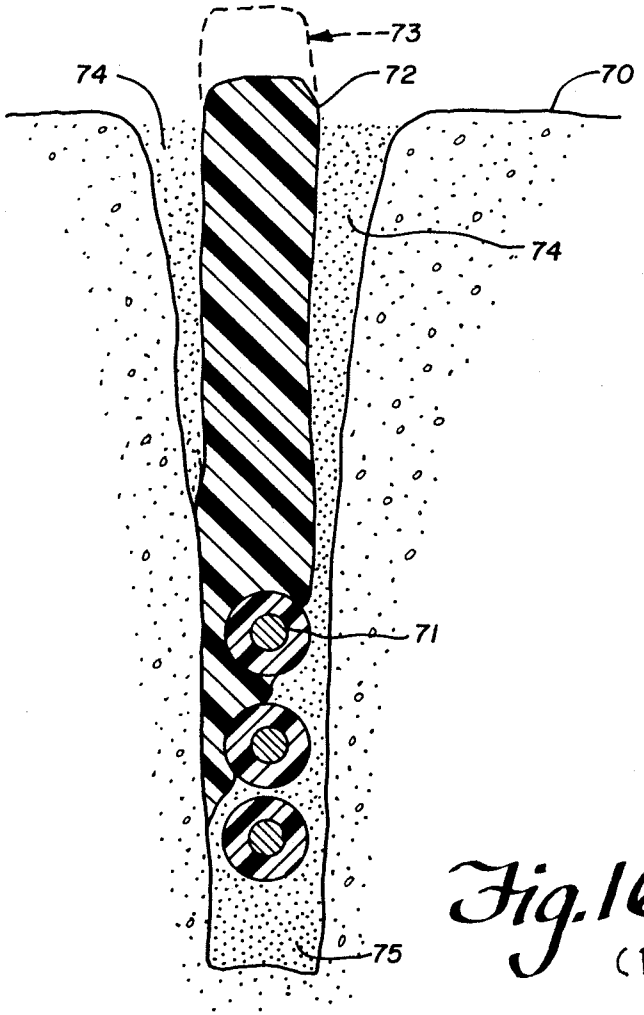
Fig. 16 (PRIOR ART)
FIG. 16 is a side sectional view of the typical prior art installation of induction loop conduit in a roadway.

The advantages of the present method of installing an induction loop detector by means of routing rather than by the use of a concrete saw are shown in FIGS. 16 and 17. FIG. 16 is a cross-sectional view of a prior art induction loop detector installed in a slot 73 which has been made by a concrete saw in a roadway 70. The prior art induction loop wire 71 has experienced a progressive upward movement from its original position due to the action of water and debris which enter the saw cut due to insufficient clean-up of slurry and due to the continual action of thermal differential expansion and contraction of the sealant and roadway, thereby allowing fine grit to fall to the bottom of the slot. The typical prior art sealant used to seal a saw cut installed induction loop system consists of epoxy material which often fails due to brittleness and lack of adhesion to the sides of the slot. Epoxy has very limited expansion/contraction capability as the temperature cycles pass through extremes. Once the integrity of the epoxy seal is penetrated, potential loop degradation arises from freeze/-thaw cycles and electrical current leakage to ground caused by moisture penetration. In addition, the typical prior art epoxy sealant does not flow uniformly into the lower parts of the saw cut as shown in FIG. 16. The sealant 72 is typically blocked in its downward flow by the presence of the induction loop wire 71. Freezing and thawing action also breaks down the sides of the saw cut as shown at 74 in FIG. 16. Debris and foreign materials enter the area between the roadway and the sealant and form a wedge which further acts to degrade the integrity of the sealant and the induction loop detector system. This also forces the sealant up and out of the slot.

In contrast to the prior art, the present invention includes a novel method of installation wherein a high polymer content asphalt rubber is used as a sealant as shown in FIG. 17. In addition, the slot containing the conduit is dry routed in the roadway with an asphalt router. This eliminates the large amounts of cooling water and slurry material which typically enter the slot. No drying out time or labor intensive clean-up is required. Additionally, a dry routed slot leaves a rougher edge 76 which provides greater adhesion between the edge of the slot 76 and the asphalt rubber sealant 78. The asphalt rubber sealant thus provides a water tight installation with greatly improved expansion/contraction properties which can compensate for pavement displacement through extreme temperature changes. The particular asphalt rubber sealant implemented in the present invention is that developed by Crafco Corp. denoted "parking lot sealant" (PLS). Additional polymers are added to stiffen the asphalt rubber. Crafco PLS is a hot melt, asphalt rubber sealant material supplied in solid form which, when properly applied, forms a resilient and adhesive seal in pavement cuts. The sealant is specifically formulated to be relatively stiff at ambient temperatures while remaining flexible at low temperatures. The sealant is thus ideally suited for use in roadways because it can withstand the continual expansion and contraction due to temperature changes. At application temperatures, approximately 30 poise at 375 degrees F, Crafco sealant is a thin fluid which pours easily and penetrates even fine cracks thus enabling an induction loop conduit 14 placed in a routed slot 76 to be completely sealed against moisture.

The expansion/contraction capability of the Crafco asphalt rubber sealant is achieved by the addition of large quantities of ground rubber to the mixture. As much as 20–25% of the mixture comprising the sealant is ground rubber. This makes the sealant extremely adhesive and long lasting.

An additional advantage of using asphalt rubber sealant such as Crafco PLS is that it is non-toxic and does not contain any carcinogenic materials. Accordingly, this product is suitable for widespread use in the substrate of roadways without any harmful environmental effects.

Thus, it can be appreciated that the present method of installing an induction loop detection system through dry routing the cuts and then sealing the conduit in place with an asphalt rubber sealant presents significant advantages over the prior art in terms of eliminating the labor intensive clean-up of slurry material and drying out of the saw cuts before installation of the wire, and in greatly increasing the lifetime of the seal and consequently the reliability and performance of the induction loop system.

The induction loop cable assembly according to the present invention provides four protective layers of electrical insulation. These are: the insulation of the conductor itself; the conduit filler sealant, the non-metallic conduit; and the asphalt rubber compound used to seal the conduit in place in the roadway slot. In contrast, the prior art has a single effective layer of insulation, namely the insulation of the wire itself.

The hard shell of the conduit of the present invention protects the wires from penetration by non-compressible objects. Should a pothole develop, the conduit alone will withstand heavy vehicle traffic.

Figure 18:
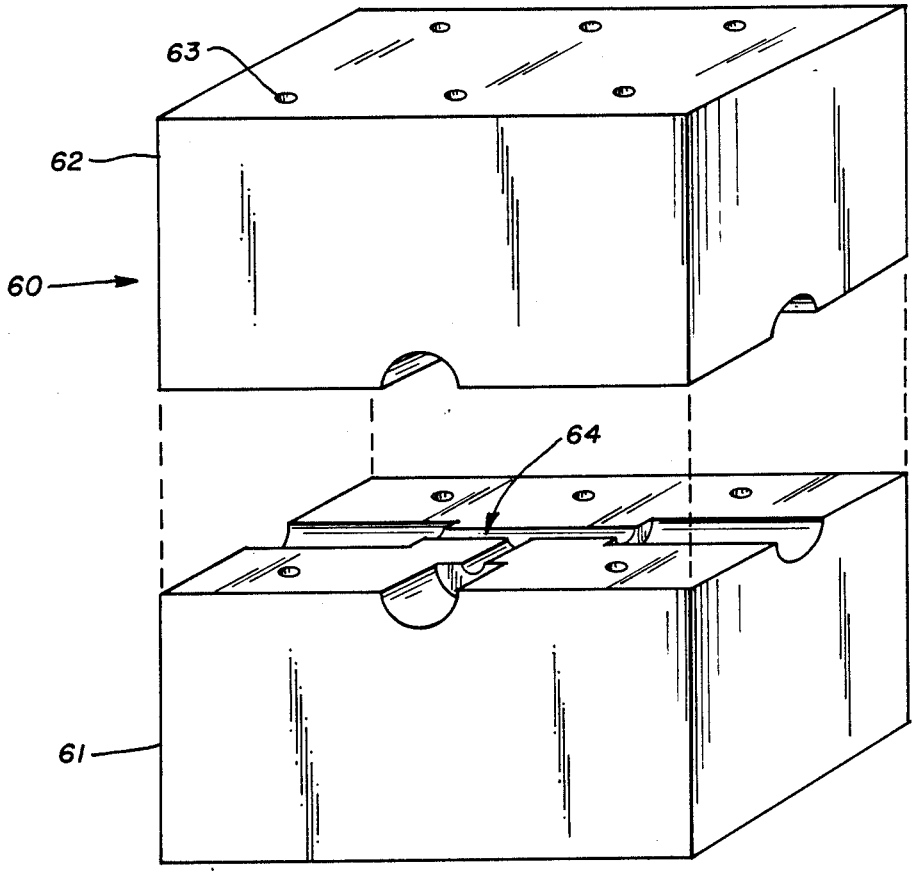
FIG. 18 is a perspective of complementary sections of a block for injecting sealant into a wired conduit and T expansion joint according to the present invention.

Referring now to FIG. 18, a method of manufacturing the prewired, non-metallic, hard shell, fully sealed, predimensioned induction loop detector cable assembly according to the present invention is described. Two aluminum blocks 61 and 62 represent two complementary halves of an aluminum feed block 60 for clamping and sealing the induction loop. Various combinations of straight and T feed blocks can be used to manufacture an induction loop in any desired configuration. The feed blocks 61 and 62 can be T shaped as in FIG. 18 or can be feed blocks for "straight" or corner expansion/contraction joints. For illustrative purposes, FIG. 18 shows T expansion/contraction joint feed blocks. The blocks 61 and 62 can be clamped together or bolted together through bolt holes 63. The inside chamber diameter 64 substantially matches the inside diameter of the conduit to provide space for contraction of the wire/sealant combination inside the expansion/contraction joint.

Initially, the overall configuration of an induction loop assembly as it will appear when placed in the roadway is determined. The polypropylene or PVC tubing which will be used as conduit for housing the induction loop wires is cut to conform to the desired final configuration of the induction loop.

Note that loop conduit sections are slightly oversized to compensate for small errors in layout and routing of the slots. Typically, one inch oversize is adequate to compensate for an installation tolerance of 2 inches.

Expansion/contraction joints are then chosen to conform to the desired configuration. Expansion/contraction joints are provided where necessary. The length and type of wire used as the induction loop conductor is then determined. It has been found that optimally, the conductor is a sixteen gauge TFFN wire. However, 14 THHN or 18 TFFN gauge THHN wire can also be used. The inside diameter of the polypropylene or PVC conduit housing the wire is typically ⅜ inch. However, diameters of ½ or ¾ inch are also adequate. The cut tubing lengths for conduit are mounted into feed blocks 60. The sliding sleeve expansion joints are slipped over the conduit and mounted between the blocks where appropriate. The channels in feed blocks 60 and 62 are treated with a quick release compound spray. The appropriate gauge wire is pulled through the PVC or polypropylene conduit and the feed blocks. Feed blocks 60 and 62 are then assembled as a single unit and clamped together.

The sealant to be injected into the conduit to seal the wires is then heated to a working temperature of approximately 400 degrees F. The induction loop detector sealant for use within the conduit is typically an asphalt rubber compound. This combines high durability and high strength with moisture protection and ease of installation. Asphalt rubber sealant is preferred because of the characteristics set forth above. Any asphalt rubber sealant having a high rubber content (20–25%) is adequate. The induction loop as assembled is then tilted in order to feed the working sealant into the blocks against gravity and therefore eliminate air bubbles. The hot sealant is injected under pressure at the lowest point in the loop. The loop is filled until the sealant is expelled from the upper most point of the induction loop. It should be noted that the interconnects and home run to the curb side junction boxes which have been assembled to the induction loop(s) are also sealed during this process. Thus, the interconnects or home runs are integral with the remainder of the induction loop(s). After sealant is expelled from the upper most point of the induction loop, the sealing process is complete and the wires within the conduit are completely sealed. The conduit is then sprayed with water or wiped with a wet cloth in order to quickly cool the conduit and thereby permanently set the shape of the induction loop. The clamped aluminum feed blocks are then released and removed from the conduit. A completely preconfigured, predimensioned and sealed induction loop with integrally sealed and predimensioned interconnections to curb side junction boxes and other induction loops is now ready for shipment. Note that the expansion joints have previously been in place in accordance with the final configuration. The expansion/contraction joints are now slideably removed so that the entire preconfigured induction loop assembly can be folded down for shipment to the customer. Thus, the above described manufacturing method assures a completely water tight, modular induction loop cable assembly.

The foregoing method of assembly allows any number of induction loops to be completely preassembled in accordance with the desired final configuration and integrally joined together with other loops. Thus, the foregoing method of assembly enables the manufacture of a modular induction loop detection system wherein individual loops for various traffic lanes can be color coded, numbered, or otherwise marked for ease of assembly in the field.

The conduit assembly of the present invention has widespread application as a cable assembly relating to the transmission of both electrical and optical signals. Examples of such applications include buried power lines, fiber optic communications, high voltage control and isolation. Such cable could be advantageously placed in airport runways, onboard naval vessels and or in aircraft. An obvious benefit of a cable assembly constructed according to the present invention involves enhanced personnel safety.

It will be appreciated by those skilled in the art that other configurations of an induction loop detector system may be made with a loop assembly conforming to the present invention. In particular, expansion/contraction joints made according to the present invention may also be made in other forms than those shown. It will therefore be appreciated that although the invention has been particularly shown and described with reference to the foregoing preferred and most practical embodiments, it is to be understood that the invention is not limited to the disclosed embodiment, but, on the contrary is intended to cover various modifications and equivalent arrangements included within the spirit and scope of the invention as defined in the claims. Therefore, persons of ordinary skill in this field are to understand that all such equivalent structures are to be included within the scope of the following claims.

What is claimed is:

1. In an introduction loop vehicle detector for installation in a vehicular roadway a modular, predimensioned, sealed induction loop vehicle detector assembly comprising:

a plurality of flexible conduit sections housing a conductor and forming a predetermined loop placeable in the bed of a roadway;

a plurality of couplings joining said conduit sections, said couplings being axially slidable with respect to said conduit sections during and after installation of said assemlbly in sid roadway to enable longitudianal displacement of said conduit sections relative to said couplings to accommodate relative dimensional changes between said loop detector and said roadway; and a flexible sealant completely filling said conduit sections to thereby surround and seal said conductor.

2. A modular, predimensioned induction loop assembly as in claim 1 wherein said couplings are slidable over the ends of said conduit sections after assembly of the same together but prior to installation of said assembly in said roadway to thereby enable said predetermined loop to be folded down for ease of carrying and field assembly.

3. A modular, predimensioned induction loop vehicle detector assembly according to claim 1 wherein said flexible conduit sections consist of polypropylene.

4. A modular, predimensioned induction loop vehicle detector assembly as in claim 1 wherein said flexible conduit sections consist of a pressure resistant, non-conductive material such as polyvinylchloride.

5. A modular, predimensioned induction loop assembly as in claim 1 wherein said conductor is sealably surrounded along its entire length with a non-conductive material such as asphalt rubber.

6. A modular, predimensioned induction loop assembly according to claim 1 including a plurality of induction loops which are integrally joined through said couplings and said loops are marked to facilitate modular assembly.

7. In ao induction loop vehicle deteotor assembly to be installed in a vehicular roadway, said assembly having a conductor extending in a loop shaped conduit filled with a conductior surrounding sealant, a coupling for joining sections of the conduit comprising:

a body defining a bore extending longitudinally therethrough, said bore being sized to slidably receive at each end thereof, an end section of conduit to be joined; and said longitudinal bore having a central region intermediate of the end sections of said bore enabling longitudinal displacement of said end sections of conduit relative to said central region during and after installation of said assembly in said roadway to accomodate relative dimensional changes between said loop detector assembly and said roadway.

8. A coupling according to claim 7 wherein said internal diameter of said bore is slightly greater than the external diameter of said conduit such that said conduit ends are slideably removable from said couplling to thereby enable said loop shaped conduit to be folded down for ease of carrying.

9. In an induction loop vehicle detector to be installed in a vehicular roadway, said detector having a conductor extending in a loop shaped conduit filled with a conductor surrounding sealant, a coupling for joining sections of the conduit comprising:

a body defining a first bore of said assembly extending therethrough along a longitudinal axis of said body slidably receiving the ends of conduit during and after installation, to accomodate relative dimensional changes between said loop detector and said roadway sections in said roadway and said body further defining a second bore having one end for slidably receiving an end section of conduit and having a second end intersecting said first bore intermediate of the ends of said first bore and at an angle substantially perpendicular to the longitudinal axis thereof wherein the intersection of said first and second bores defines a receptacle for joining end sections of conduit and for enabling longitudinal displacement of said end sections within said receptacle.

10. A coupling according to claim 9 wherein said body is further comprised of two complementary halves snapped together to thereby enable quick assembly and disassembly of said body without adhesive.

11. In an introduction loop vehicle detector to be installed in a vehicular roadway, said detector having a conductor extending in a loop shaped conduit filled with a conductor surrounding filler, a coupling for joining sections of conduit comprising:

a fitting defining a passageway extending longitudinally therethrough sized to receive at each end thereof, a conductior extending from end sections of conduit to be joined, said passageway being filled with a conductor surrounding filler;

a sleeve having a first end slidably receiving an end of said fitting and having a second end sized to receive an end section of conduit, wherein said sleeve enables longitudinal displacement of said conduit and said conductor therein during and after installation, to accomodate relative dimensional changes between said loop detector and said roadway; and means for slidably and matingly engaging said first end of said sleeve with said end of said fitting.

12. A coupling as in claim 11 further comprising a second sleeve having means for matingly engaging a second end of said fitting at one end thereof and slideably receiving a second conduit at it other end, the interior of said second sleeve providing a space enabling the longitudinal displacement of said conduit and said conductor.

13. A coupling as in claim 11 or 12 wherein said means for matingly engaging said sleeve with said fitting comprises a series of complementary ridges and recesses located on the exterior surface of said fitting end and on the interior surface of said sleeve, respectively.

14. A coupling as in claim 11 wherein said fitting comprises a T fitting having an end portion defining a second passageway transversely intersecting said first passageway and having an interior region sized to receive a section of a conductor extending from an additional conduit section to be joined; and an additonal sleeve having one end for engageably receiving said T fitting end portion defining said transverse passageway and having a second end for receiving said additional section of conduit, said interior of said additional sleeve defining a space enabling the longitudinal displacement of said additional conduit section and said conductor.

* * * * *